US008231845B2

(12) United States Patent
Wyzgol et al.

(10) Patent No.: US 8,231,845 B2
(45) Date of Patent: Jul. 31, 2012

(54) STRUCTURES FOR UNIFORM CAPILLARY FLOW

(75) Inventors: Raimund C. Wyzgol, Dortmund (DE); Holger Bartos, Dortmund (DE); Ralf-Peter Peters, Bergisch Gladbach (DE); Christian Schön, Dortmund (DE); Dirk Osterloh, Unno (DE); Gert Blankenstein, Dortmund (DE)

(73) Assignee: Steag Microparts, Dortmund (DE)

( * ) Notice: Subject to any disclaimer, the term of this patent is extended or adjusted under 35 U.S.C. 154(b) by 1324 days.

(21) Appl. No.: 10/885,962

(22) Filed: Jul. 6, 2004

(65) Prior Publication Data

US 2004/0241051 A1 Dec. 2, 2004

Related U.S. Application Data

(63) Continuation of application No. 10/032,368, filed on Oct. 25, 2001, now Pat. No. 6,776,965.

(60) Provisional application No. 60/243,246, filed on Oct. 25, 2000, provisional application No. 60/305,824, filed on Jul. 16, 2001.

(51) Int. Cl.
*B01L 3/00* (2006.01)

(52) U.S. Cl. ..... 422/507; 422/412; 422/502; 422/503

(58) Field of Classification Search ..... 422/100, 422/102, 70, 412, 502–504, 507; 436/162
See application file for complete search history.

(56) References Cited

U.S. PATENT DOCUMENTS

| | | | | |
|---|---|---|---|---|
| 3,667,607 | A * | 6/1972 | Brandt | 210/198.3 |
| 3,752,316 | A * | 8/1973 | Takeshita | 210/198.3 |
| 4,757,004 | A * | 7/1988 | Houts et al. | 435/7.91 |
| 5,458,852 | A * | 10/1995 | Buechler | 422/58 |
| 5,486,335 | A | 1/1996 | Wilding et al. | 422/55 |
| 5,866,345 | A | 2/1999 | Wilding et al. | 435/7.21 |
| 6,068,752 | A | 5/2000 | Dubrow et al. | 204/604 |
| 6,270,641 | B1 * | 8/2001 | Griffiths et al. | 204/451 |
| 6,315,953 | B1 | 11/2001 | Ackley et al. | 442/68.1 |
| 6,451,608 | B1 | 9/2002 | Kikuchi | 436/63 |
| 7,223,364 | B1 * | 5/2007 | Johnston et al. | 422/68.1 |
| 2002/0076727 | A1 | 6/2002 | Cardone et al. | 435/7.1 |
| 2002/0137218 | A1 | 9/2002 | Mian et al. | 436/45 |

* cited by examiner

*Primary Examiner* — Jan Ludlow
(74) *Attorney, Agent, or Firm* — Edwards Wildman Palmer LLP; Peter F. Corless; Andrew W. Shyjan, Esq.

(57) ABSTRACT

The present invention relates to devices for efficient transport, transfer and movement of fluids. In particular, the invention provides fluidic micro-structures for controlled transport and movement of liquids in devices for analytical and other purposes. Devices of the invention include one or more features that can enhance performance of the fluid transfer, referred to as a pre-shooter stop, a butterfly structure, a cascade structure, a waste chamber inlet, a capillary driven sample inlet chamber, a capillary stop structure, a bifurcation flow-through structure, and a hydrophobic vent.

6 Claims, 7 Drawing Sheets

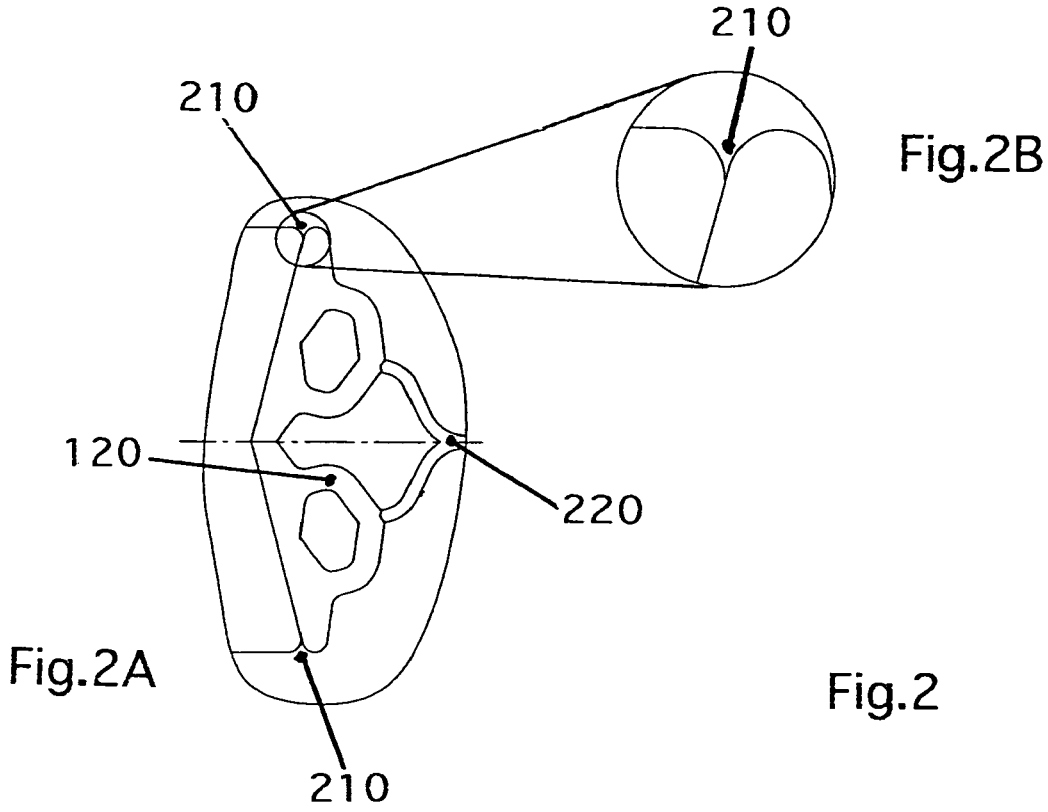
Fig.2B
Fig.2A
Fig.2
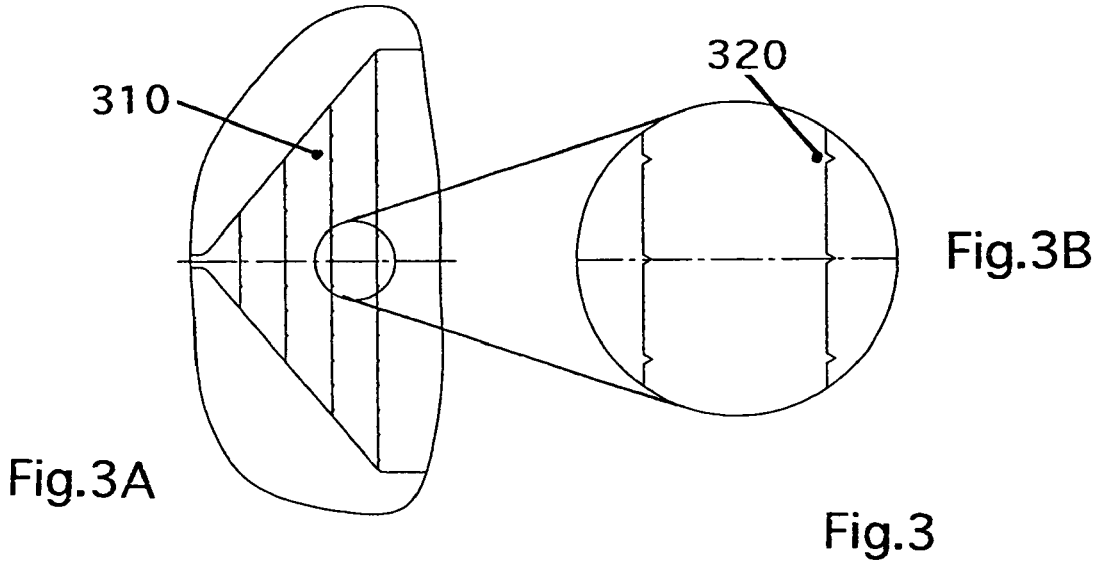
Fig.3B
Fig.3A
Fig.3

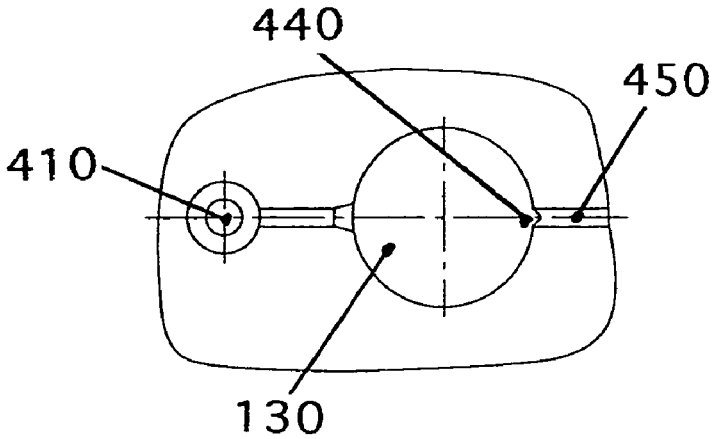
Fig.4C
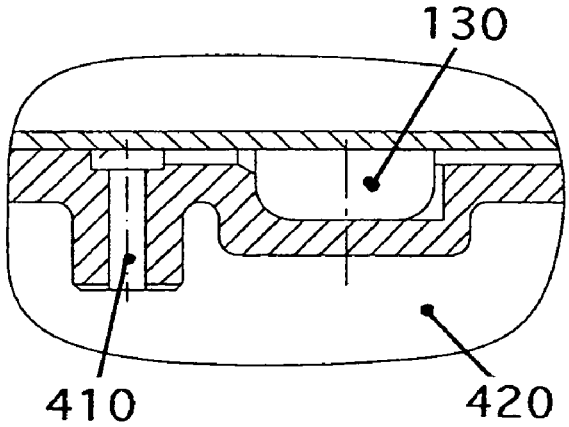
Fig.4B
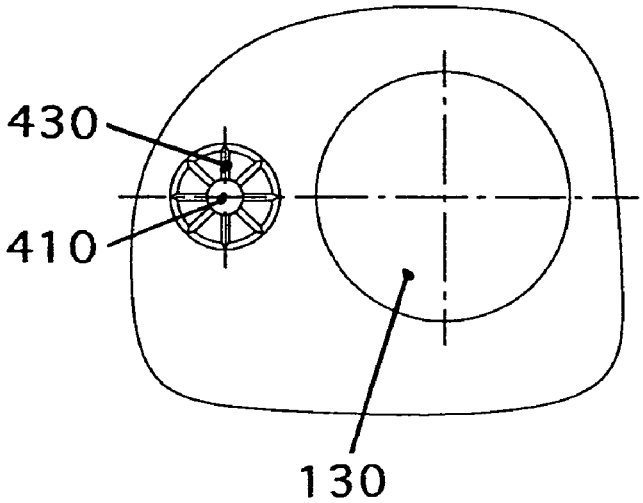
Fig.4A
Fig.4

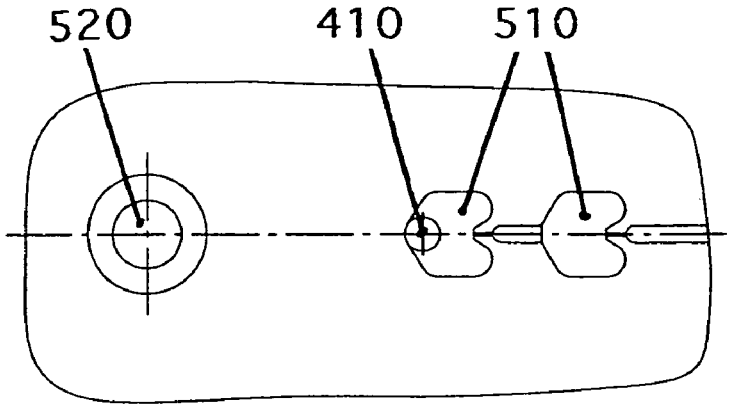
Fig.5C
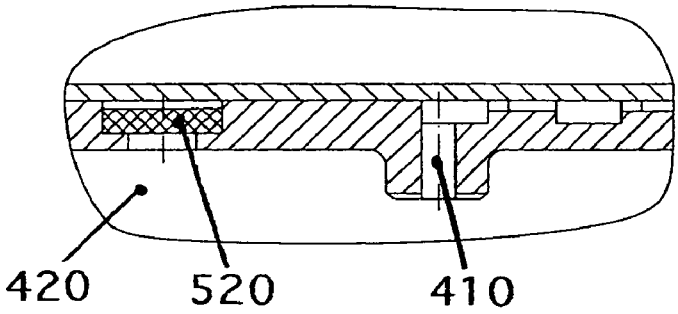
Fig.5B
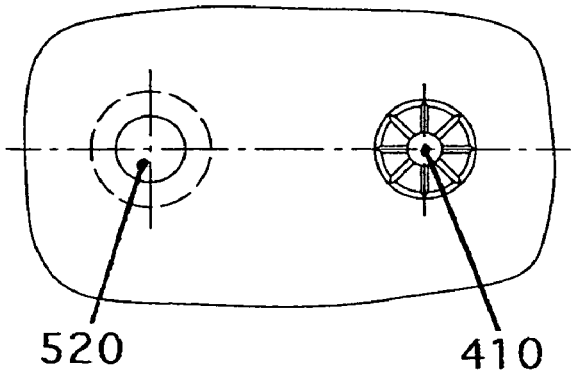
Fig.5A
Fig.5

Fig.6A
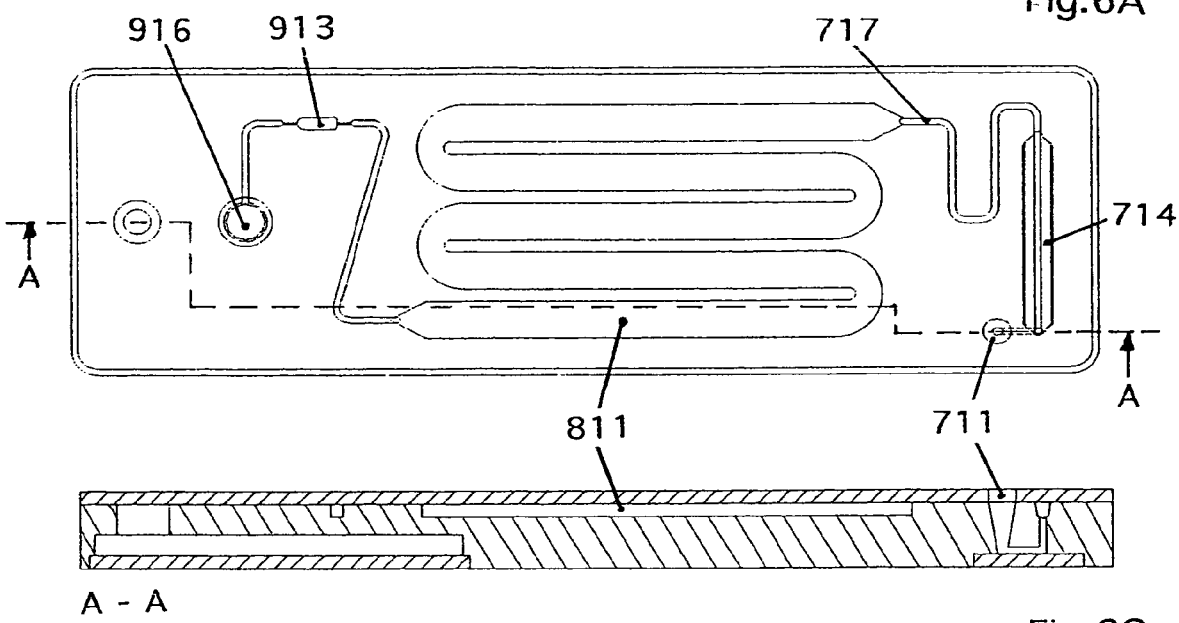
Fig.6C
Fig.6B
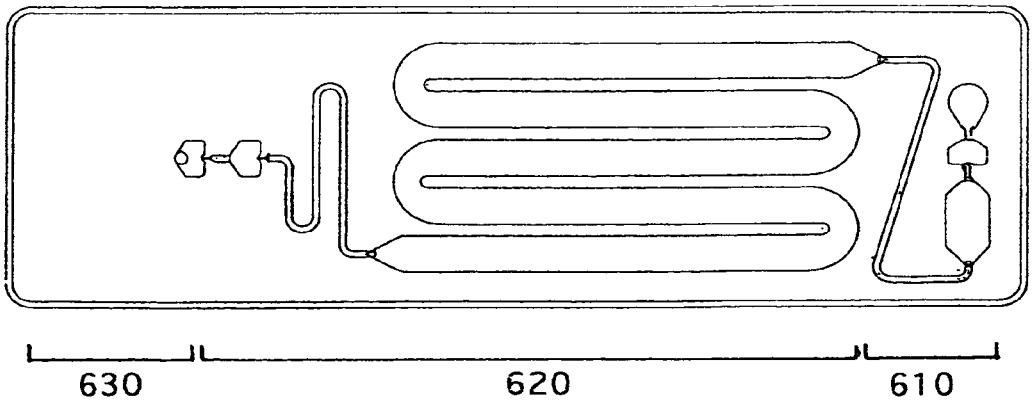
Fig.6

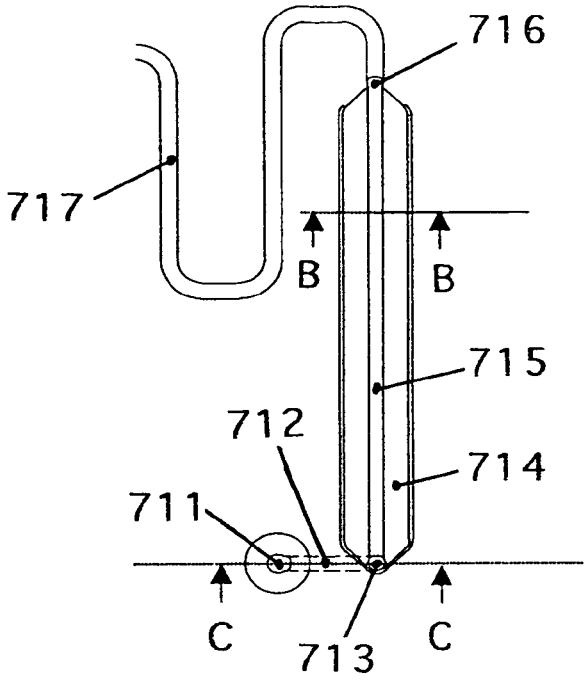
Fig.7A
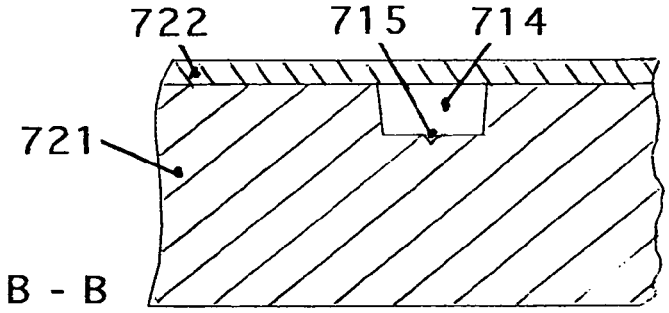
Fig.7B
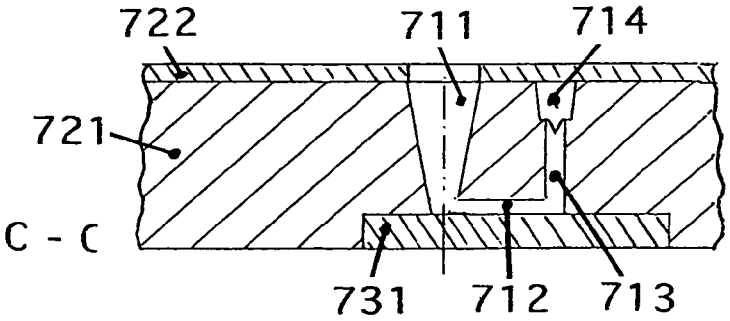
Fig.7C
Fig.7

STRUCTURES FOR UNIFORM CAPILLARY FLOW

The present application is a continuation of U.S. patent application Ser. No. 10/032,368, filed Oct. 25, 2001, now U.S. Pat. No. 6,776,965, which claims the benefit of U.S. provisional application No. 60/243,246, filed Oct. 25, 2000, and U.S. provisional application No. 60/305,824, filed Jul. 16, 2001, both of which applications are incorporated herein by reference in their entirety.

BACKGROUND OF THE INVENTION

1. Field of the Invention

The present invention relates to devices for efficient transport, transfer and movement of fluids. In particular, the invention provides fluidic micro-structures for controlled transport and movement of liquids in devices for analytical and other purposes. Devices of the invention include one or more features that can enhance performance of the fluid transfer, described below and referred to as a "pre-shooter stop", a "butterfly" structure, a "cascade" structure, a waste chamber inlet, a capillary driven sample inlet chamber, a capillary stop structure, a bifurcation flow-through mechanism, and a hydrophobic vent.

2. Background

The development of bio-array technologies promises to revolutionize the way biological research is carried out. Bio-arrays, wherein a library of biomolecules is immobilized on a small slide or chip, allow hundreds to thousands of assays to be carried out simultaneously on a miniaturized scale. This permits researchers to quickly gain large amounts of information from a single sample. In many cases, bio-array type analysis would be impossible using traditional biological techniques due to the rarity of the sample being tested and the time and expense necessary to carry out large-scale analysis.

Bio-arrays or chips as substrate platforms for analytical purposes will continue to transform the way the analysis and the determination of materials will be carried out in the future. Low cost chips will become established in a variety of fields where easy and rapid analysis is demanded with very low amount of sample availability. For example, such fields may include: medical, clinical, biochemical, chemical, environmental, food, and industrial analysis. In many of these areas, analysis is limited or even impossible using traditional laboratory techniques due to the very time-consuming and expensive procedures, combined with high sample volume requirement.

Although bio-arrays are powerful research tools, they suffer from a number of shortcomings. For example, bio-arrays tend to be expensive to produce due to difficulties involved in reproducibly manufacturing high quality arrays. Also, bio-array techniques cannot always provide the sensitivity nor the consistent results necessary to perform desired experimentation. Therefore, it would be desirable to provide an improved device which is available for a variety of miniaturized analytical purposes including analytical chips, and allowing for effective transport, delivery, and removal of liquids for efficient experimentation using bio-arrays.

SUMMARY OF THE INVENTION

The present invention provides novel fluidic devices for efficient transport of fluids. Devices of the invention are suitably employed for analytical studies and other applications using bio-arrays or microchips.

Devices of the invention include one or more features that can enhance performance of fluid transfer through the device structure, such features are generally referred to herein as a pre-shooter stop, a butterfly structure, a cascade structure, a waste chamber inlet, a capillary driven sample inlet chamber, a capillary stop structure, a bifurcation flow-through mechanism or structure, and a hydrophobic vent.

Preferred devices of the invention, including microstructured devices useful for analytical purposes can comprise a filling station or section, an analysis station or section and a waste station or section. Generally preferred devices according to the invention include one or more features that can enhance performance of fluid transfer through the device structure, such features generally referred to herein as a sample inlet chamber (e.g. a capillary drive sample inlet chamber), a butterfly structure, a bifurcation flow-through structure, a cascade structure, a pre-shooter stop structure, a capillary stop structure (e.g. a flow-gate, optionally with evaporation stop), a vent (e.g. a hydrophobic vent), a waste outlet, a waste collecting chamber, and a waste inlet into a waste collecting chamber.

The filling section can comprise an inlet port, an inlet channel, a filling chamber and an outlet channel. The inlet channel connects the inlet port to one end of the filling chamber, the volume of which is preferably sufficiently large to take up the entire volume, or essentially entire (e.g. at least about 95 vol %) of a fluid sample. The outlet channel connects preferably the other end of the filling chamber (opposite to the inlet channel) top the analysis section.

The analysis section can comprise a channel, the entrance of which is connected to the filling section. The volume of the channel of the analysis section is suitably less than the volume of the filling chamber. The cross-section, the length and the shape of the channel located in the analysis section are adapted to the intended use of the device.

The waste section comprises at least an outlet for the fluid leaving the analysis section. The waste section can comprise further a waste chamber for collecting fluid coming out of the analysis section, and a connecting channel between the exit of the analysis section and the waste collecting chamber.

The filling section, the analysis section and the waste section can comprise various structures for the precisely controlled transport of fluids through said sections.

In further detail, a pre-shooter stop of devices of the invention can inhibit undesired edge fluid flow, i.e. where an introduced fluid flows through the device more quickly along the flow channel edges than the middle regions of the flow channel. The pre-shooter stop includes irregularly-shaped edges of the flow channel, particularly triangular or saw-toothed edges that allow for an even advancing flow line through a flow channel.

The butterfly and cascade structures of devices of the invention can provide a more homogeneous spread of a fluid stream that enters a relatively wider flow area from a narrower flow area. The butterfly structure as referred to herein is a symmetrical V-shaped or delta-shaped pair of flow channels that emerge from a single flow channel. The two channels have the same cross-sectional area as the single channel that flows or feeds fluid into the two channels. The two channels present a common V-shaped front to the single channel that feeds fluid into the channels.

The cascade structure as referred to herein includes a triangular shaped structure with steps (terraces) of increasing depth in the direction of the triangle top, thereby providing a decreased capillary force. That structure can provide for flowing fluid to fill out each level or step before flowing to a next level, again promoting a homogeneous spread of fluid.

A device of the invention also can include a certain fluid inlet coupled to a waste structure that receives spent test sample, wash fluids, etc. The waste chamber inlet contains an inlet neck that is graded with notches that can contact and adhere to fluid absorbent material such as fleece contained within the waste chamber.

A device of the invention also may contain a fluid receiving chamber that promotes capillary flow of the fluid through the device. The receiving chamber suitably can be e.g. a vertical wedged-shape slot, with decreasing width into the device, or a funnel-shaped inlet with decreasing diameter into the device. Fluid can be pipetted or otherwise introduced into the receiving chamber and thereby flow via capillary forces through the device.

A device of the invention may further contain a capillary stop, which can provide for capillary fluid flow to be substantially interrupted at a defined point. A capillary stop includes a flow channel or space of low capillarity at the end of a flow channel or space of high capillarity, or a flow channel or space of low capillarity between two channels of high capillarity. Fluid will stop at the end of the channel of high capillarity and will not enter the flow space of low capillarity.

A device of the invention may further contain an air exit vent that is capped by a hydrophobic, air permeable material. The material may suitably be a hydrophobic polymer frit or a polymer membrane. Such a cap enables air to exit from the device, as well as air to degass from the fluid, as fluid fills the device. The cap can also serve as a stop for the fluid upon filling of the device flow path(s); and as a marker for filling of the device with fluid.

Fluidic devices of the invention are "closed" systems, i.e. where fluid flows into an encased compartment. As discussed above, the device provides ports for introduction of liquid into the container and venting of air out of the container. The ports connect to a fluid flow system, which preferably can operate by capillary forces. The device also may contain an outlet port, suitably coupled with a waste chamber within the container, provided for expelling and containing waste materials.

Function and effect of the filling section are suitably provided as follows. The predetermined volume of the fluid sample is introduced into the inlet port e.g. by use of a pipette. The tip of the pipette can be tightly pressed into the funnel-shaped inlet port. The fluid enters the connecting channel from the inlet port to the filling chamber, if necessary by applying some pressure onto the fluid in the pipette. Upon filling of the filling chamber with fluid, the pipette can be withdrawn.

During filling of the filling chamber and subsequently filling of the analysis section and optionally partially filling of the waste section, air is suitably vented from the channels and hollow spaces through the vent.

The filling section allows the well-defined filling of the analysis section by capillary forces alone or by applying external forces. The arrangement of the filling section allows filling of the analysis section completely without bubbles independently from the skill of the operator.

The volume of the filling chamber suitably can vary widely depending on device design, e.g. from about 1 microliter to about 1000 (one thousand) microliter, more typically from about 1 microliter to about 500 microliter, still more typically from about 1 microliter to about 100 microliters.

Function and effect of the analysis section are suitably provided as follows. The analysis section comprises essentially a closed channel having a given length and a cross-section and shape of cross-section. A variety of designs are suitable, e.g. a straight hollow chamber or a curved shaped chamber. The exit of the analysis section can be connected to further fluidic structures. The hollow space of the analysis section can be filled by capillary forces and/or additionally by active flow propulsion depending on the ratio of chamber width to chamber length and on characteristics of the fluid.

Within the hollow space of the analysis section e.g. chemical reactions or bio-reactions or hybridization or other effects can take place resulting in an alteration of preferably optical properties of the fluid contained in the analysis section. Such properties can be detected by known optical methods.

The waste section is determined for removing fluid coming out of the analysis section and preferably for collecting such fluid in a waste chamber.

Devices of the invention may have one or more preferably more than one or all of the above-discussed features, i.e. a pre-shooter stop, a butterfly structure, filling section, analysis section, a cascade structure, a waste chamber inlet, a capillary driven sample inlet chamber, a capillary stop structure, a bifurcation flow-through mechanism, and a hydrophobic vent, and other features mentioned herein.

Devices of the invention are suitably used for applications or assays which include biomolecules introduced into the device, including nucleic acids, peptides, and the like.

BRIEF DESCRIPTION OF THE DRAWINGS

The following drawing figures are illustrative of the invention.

FIG. 2 (which includes FIGS. 2A and 2B) shows an exemplary butterfly structure 120, pre-shooter stops 210 and a bifurcation flow-through 220;

FIG. 3 (which includes FIGS. 3A and 3B) shows an exemplary cascade structure with terraces of different depth 310 and notches 320;

FIG. 4 (which includes FIGS. 4A, 4B and 4C) shows a capillary driven sample inlet chamber 130 and a waste chamber inlet 410 as a bottom view, longitudinal cross-section view and top view;

FIG. 5 (which includes FIGS. 5A, 5B and 5C) shows an exemplary capillary stop structure system 510 in front of a waste chamber inlet 410 and a hydrophobic vent 520 (bottom view, longitudinal cross-section view and top view);

FIG. 6 (which includes FIGS. 6A, 6B and 6C) shows a top view of two exemplary microstructured devices (FIGS. 6A and 6B) having a filling section 610, an analysis section 620 and a waste section 630. FIG. 6C is a cross-sectional view of the device according to FIG. 6A;

FIG. 7 (which includes FIGS. 7A, 7B and 7C) shows details of an exemplary filling section. FIG. 7A is a top view of the filling section. FIGS. 7B and 7C are cross-sectional views of the filling chamber at the lines B-B and C-C of FIG. 7A, respectively;

DETAILED DESCRIPTION OF THE INVENTION

Figure 1:
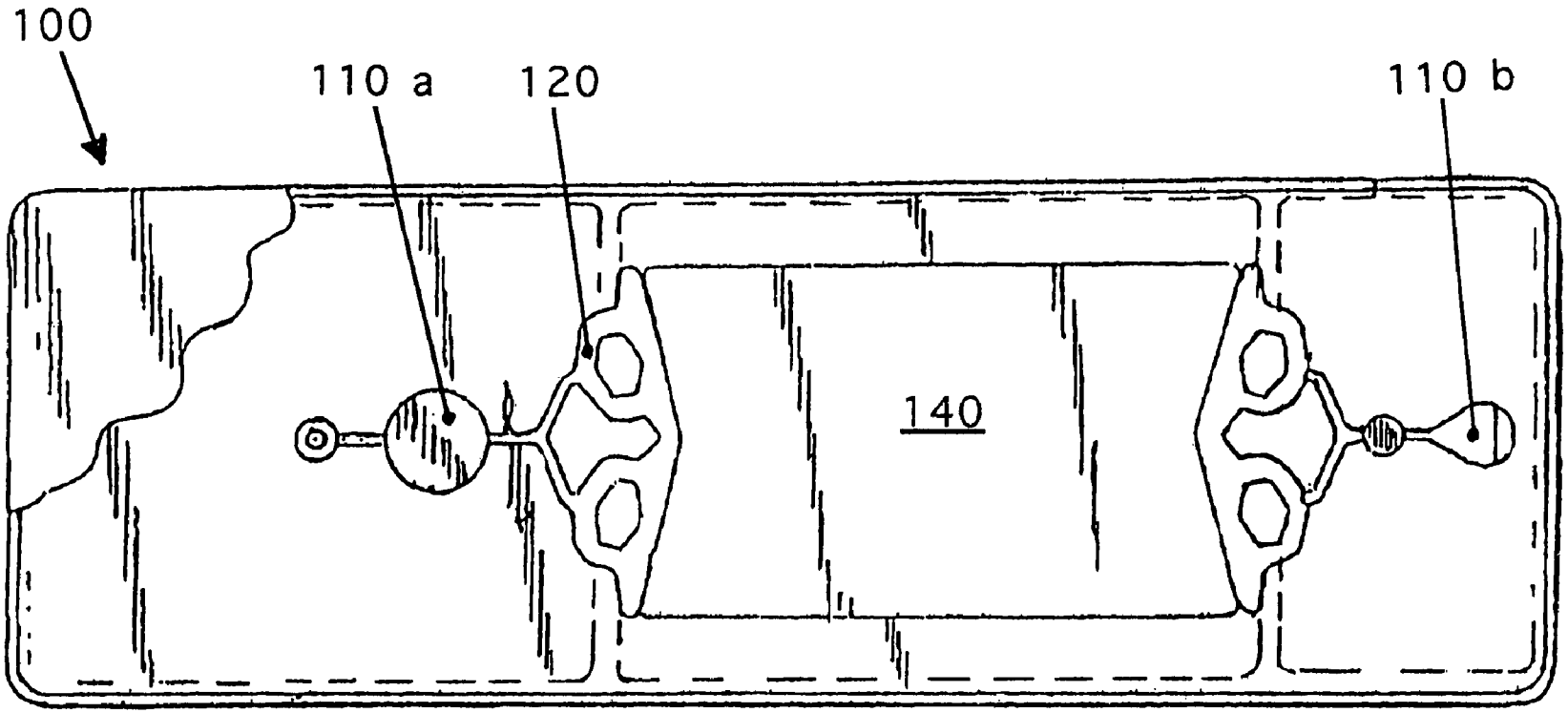
FIG. 1 shows a top view of an exemplary micro structured device useful for analytical purposes.

As discussed above, devices of the invention include one or more features that can enhance performance of fluid transfer through the device structure, such features are generally referred to herein as a pre-shooter stop (210 in FIGS. 2A and 2B), a butterfly structure (120 in FIG. 1), a cascade structure (310 in FIG. 3A), a waste chamber inlet (410 in FIG. 4A), a capillary driven sample inlet chamber (130 in FIGS. 4A to 4C), a capillary stop structure (510 in FIG. 5C), a bifurcation flow-through mechanism or structure (220 in FIG. 2A), and a hydrophobic vent (520 in FIGS. 5A through 5C).

Fluidic devices of the invention may be constructed from a variety of materials such as glass, quartz, silicon, polymers, gels, plastics, resins, carbon, metal, membranes, etc. or from a combination of several types of materials such as a polymer blend, polymer coated glass, silicon oxide coated metal, etc.

The fluidic device may be constructed in a variety of shapes and sizes so as to allow easy manipulation of the substrate and compatibility with a variety of standard lab equipment such as microtiter plates, multichannel pipettors, microscopes, ink-jet-type array spotters, photolithographic array synthesis equipment, array scanners or readers, fluorescence detectors, infra-red (IR) detectors, mass spectrometers, thermocyclers, high throughput machinery, robotics, etc. For example, the fluidic device may be constructed so as to have any convenient shape such as a square, rectangle, circle, sphere, disc, slide, chip, film, plate, pad, tube, strand, box, etc. Preferably, the fluidic device is substantially flat with optional raised, depressed or indented regions to allow ease of manipulation.

The fluidic devices of the invention may be constructed by any method well known in the art. For example, methods of construction may include laser milling, hot embossing, mechanical machining, or etching. In a preferred embodiment, plastic fluidic devices are constructed using injection molding.

As discussed above, fluidic devices of the invention are constructed in a closed configuration. By 'closed configuration' it is meant that the substrate is enclosed within a substantially sealed container and has integrated microfluidic structures for sample loading and washing.

As discussed above, transport of fluid through the device can occur via capillary forces. Fluid also can be transported through the device system via pressure forces as applied e.g. externally, which force fluid through the device system, or other forces such as centrifugal, gravitational, electrical, osmotic, electro-osmotic and others. Such flow propulsion can be applied individually or in various combinations with each other.

FIG. 1 shows an exemplary device 100 of the invention which includes inlet ports 110*a* for sample loading and 110*b*, for buffer washing and air expulsion upon washing or loading. The inlet ports may be arranged in a variety of configurations so as to allow sample loading and washing without contamination of the analysis area. As discussed above, the sample ports are funnel shaped with the wide end of the funnel toward the outside of the casing and the narrow end toward the inside of the casing, in order to facilitate introduction of liquid into the closed slide.

The device may contain an integral waste chamber 420 and an inlet port to the waste chamber 410 located within the device, wherein the inner walls of the inlet are notched in order to grasp absorbent material within the waste chamber such as cloth, fleece, blotting material etc. which is capable of soaking up the waste fluid and preventing any backflow of the waste material into the analysis area 140.

More particularly, for optimal coupling of the fluidic system to the fleece or other absorbent material within the waste chamber, the neck of the waste chamber inlet has notch-structured zones 430, preferably star shaped. Such notches can function as coupling element which thereby cause increased contact surface between the inlet and the absorbent material. The wedge-shaped notches cause an initial sucking force due to capillary forces.

As discussed above, the outlet port 520 is suitably capped with hydrophobic, air permeable material to enable air to exit from the device, while preventing fluid to escape.

In fluidic devices, particularly in use with miniaturized analysis such as with bioarrays, there is the necessity to spread a fluid stream homogeneously from a narrow channel into a wide area. Often times it is necessary to disperse fluid between structures with very different cross-sections, for example, between an incoming channel and a hybridization area or a reaction chamber.

FIGS. 2 and 3 show preferred fluid transfer systems of the invention include, "butterfly" 120 and "cascade" 310 structures of channels to contend with the above-mentioned difficulties. The butterfly and cascade channel systems or combination of both can enable any of the following:

a) uniform spreading of the fluid into a homogeneous film;
b) homogeneous wetting of the surface in a reaction chamber (for example in a hybridization chamber);
c) entrance of the fluid into an analysis and/or reaction and/or detection and/or indication area with a homogeneous flow profile between two plates (the lid and the base of the substrate platform); and
d) uniform narrowing (reunion) of the liquid afterwards (after the analysis area).

The butterfly structure is a symmetrical "delta"-structured channel system 120 of bifurcations with a constant value of the cross-section (decreasing channel depth and increasing channel width with increasing number of bifurcations). The butterfly channel system initiates and/or terminates with a V-shaped border line on the wide end of the tree structure.

A constant cross-section can provide a constant flow rate as well as increasing capillary force. A V-shaped front line assists in eliminating a smiling effect and non-uniform channel depths enable dispersement of fluid to a homogeneous film, thus achieving a homogeneous flow of the liquid into the analysis area and diminishing a smiling-effect which causes an opposite flow profile by the V-shape ("anti-smiling-tree"). The peak in the middle of the V-shaped front line may be sharp or rounded. In addition to use in filling an area such as an analysis area, the butterfly structure can alternatively be used to narrow the fluid stream.

Preferred fluid transfer systems of the invention may also comprise an additional channel system of a similar structure where a triangular shaped structure with steps (terraces) 310 of increasing depth in the direction to the top of the triangle (decreasing capillary force) enables the homogeneous spreading or narrowing of the fluid stream. The cascade consists of at least two areas with different depths and therefore with different capillarities (different capillary forces). As a result, flowing fluid fills out each step completely before it climbs up or down to the next terrace. The edges of cascaded terraces may include notches as described herein for the inlet to the waste chamber, for an easier wetting of the following terrace.

As also discussed above, preferred fluid transfer devices of the invention may include a pre-shooter stop 210 to combat the difficulties associated with spreading fluid in fluidic microdevices. If a fluid enters into a wide but very narrow area between two plates; for example, between the lid and the base of a fluidic device, the liquid tends to flow at the edges of the area faster than in the middle due to regions of higher capillary force in the corner of the edge. A "pre-shooter" results if the liquid shoots very quickly along an edge. In addition, a "smiling effect" results, which means that the front line of a flowing fluid for example in an analysis area is not homogeneous and lacks a steady front, which is instead curved like a smiling face.

Preferred devices of the invention include one or more pre shooter stops 210 (see FIG. 2), which can avoid the occurrence of undesired "pre-shooters" and provide a homogeneous fluid front line. Pre-shooter stops are irregular shaped structures, preferably triangular or sawtooth shaped structures, positioned along flow channel walls, thus avoiding pre-shooters at the borders of wide, flat areas (for example, in the analysis area) and achieving a homogeneous liquid flow into and through this area. The pre-shooter stop has an angle of between about 1° and about 120° and a height of between about 1 μm and 3 mm. The structures disturb the capillary force along the edge via discontinuation. It is possible to place only one pre-shooter-stop on critical positions (for example, on each side on the border between the end of the "butterfly" structure and the beginning of the hybridization chamber). In addition, as shown in FIG. 2, it is also possible to place more than one "pre-shooter-stop" 210 along the border of an area (for example, the analysis area 140). The functionality of the pre-shooter-stops depends on the angle and the height of the tooth, because the greater the height of the stop, the more disruption results.

Additional structures of the device may also be used to achieve efficient entry and spreading of fluids in the device. As shown in FIG. 4, to fill a fluidic structure with fluid, a "capillary driven sample inlet chamber" 130 is advantageous. This chamber is able to initially hold fluid which is pipetted into the device, in the inlet port. From this chamber the fluidic channels in the device require continuous filling with liquid to a required extent in order to maintain capillary action. This has been solved by using a sample inlet chamber which comprises at least one vertical wedge-shaped capillary notch 440 which extends from the bottom of the chamber to its top, thus enabling the continuous filling of the channels 450 of the fluidic device as well as the analysis area 140 with the fluid. The content of the chamber fills the channel system, driven by the capillary force of the vertical notch. The capillary force can vary with the angle of the notch.

In fluidic devices, it can be necessary to stop fluid at a defined point and to hold the liquid in a defined position for a defined time during a process. Such a requirement occurs for example, during a chemical reaction or a physical process such as heating or cooling, etc. During heating thermal expansion of fluid must be taken into account which may cause higher forces than the usual capillary forces.

To contend with such requirements, preferred fluid transfer devices of the invention include a "capillary stop" 510. A stop comprises a transition section of channels with different capillarities. Such an element consists of a gap of low capillarity between two channels with high capillarity. Fluid flow ceases at the end of the first channel and does not enter into the gap.

A preferred use of capillary stops is a combination of two capillary stops 510, such as in front of the waste inlet 410, as exemplified in FIG. 5. The first capillary stop halts the liquid during the filling of the device, while the second stop halts the fluid during a method such as a heating step which is necessary for the analysis or assay reaction. Such combination of stops enables to stop the flow before thermal expansion and after thermal expansion of the fluid.

Additional stops may be incorporated at desired sites, such as between the inlet chamber and the washing buffer inlet. This stop avoids the flow of liquid from the filling chamber backwards into the buffer inlet.

Opposing a capillary stop, devices also may be preferred to include an "anti-stop" structure which enables a split of fluid and continuous flow through bifurcations. Under normal circumstances, splitting of a liquid stream using a T-shaped bifurcation is unreliable because of unavoidable broadening of the channel (it works like a stop, as described above). Thus, the fluid halts at the gap of capillary force.

The advantage of the "anti-stop" 220 as shown in FIG. 2 is essentially given by the shape of the bifurcation, the "Y" branches of the channel systems. In contrast to an unsuitable T-shaped bifurcation, the invention provides a curved V-shaped bifurcation where the "top of the V" reaches deep into the entrance. The "top of the V" can be a triangular shaped sharp structure inside the bifurcation. Because the top of the V reaches into the source of the fluid (thus creating a "Y" structure), the capillary force is not broken as in the traditional T bifurcation, and the fluid maintains flow.

FIG. 6A shows a microstructured device having an inlet port 711 at the entrance to the filling chamber 714, a capillary 717 connecting the exit of the filling chamber 714 and the entrance to a channel of the analysis section, a wide channel 913 between two microchannels and a waste chamber inlet 916 with notches.

FIG. 6B shows a microstructured device with an arrangement of elements in an alternative suitable format than the arrangement of FIG. 6A.

FIG. 6C shows a cross-section of the device of FIG. 6A at line A-A.

FIG. 7 shows a preferred exemplary filling section. The funnel-shaped inlet port 711 designed for taking up the tip of a pipette is connected via a bottom channel 712 and a vertical channel 713 to one end of the filling channel 714. At the bottom of the filling chamber there is a V-shaped groove extending along the whole length of the filling chamber. At the transition point from the filling chamber to connecting capillary 717 there is a capillary step 716.

The elements shown in FIG. 7A are arranged on a platform 721. The upper side of this platform is covered with a cover plate 722 covering the top surface and all elements arranged on the top surface except the inlet port and the vent opening.

The bottom channel 712 is covered by a cover plate 731 on the bottom surface of platform 721.

Figure 8:
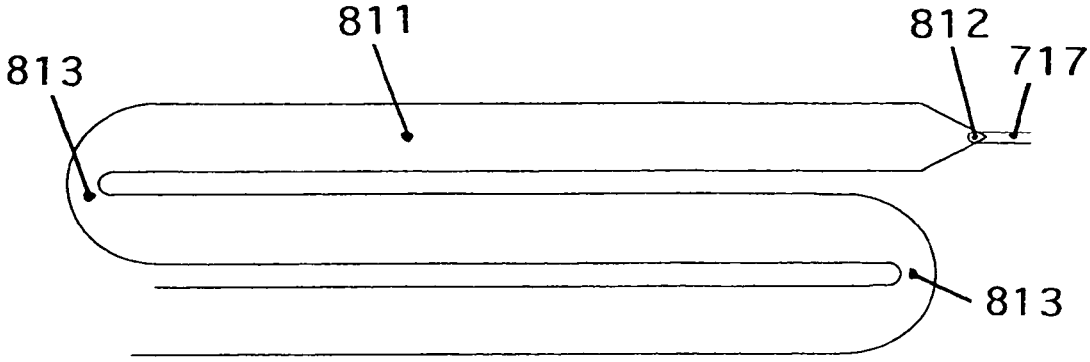
FIG. 8 shows details of a part of the analysis section in top view.

FIG. 8 shows a part of the channel 811 of the analysis section, the entrance of which is connected via capillary 717 to the filling section. At the transition point from the capillary 717 to channel 811 there is a capillary step 812.

The width of channel 811 in its bend 813 is less than the width in the straight part of channel 811.

Figure 9:
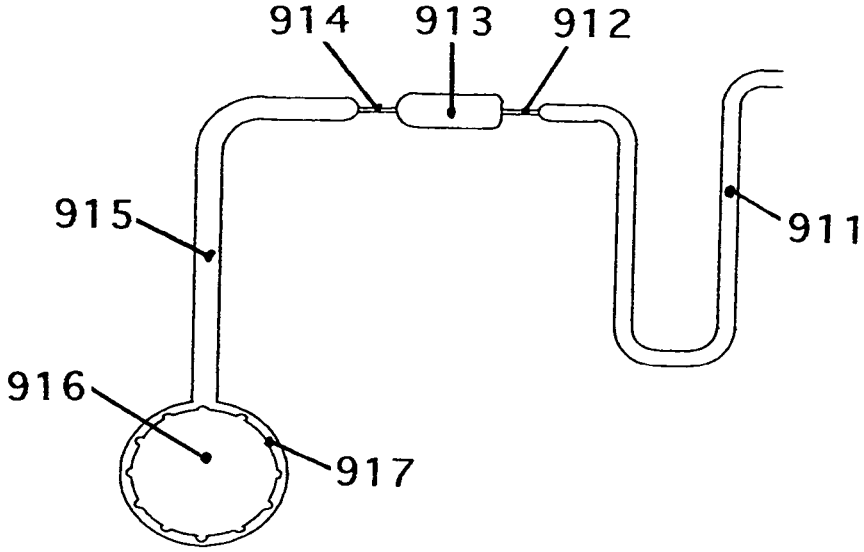
FIG. 9 shows details of an exemplary capillary stop structure followed upon an exemplary waste section inlet in top view.

FIG. 9 shows a preferred exemplary capillary stop structure positioned behind an analysis section. The comparatively wide connecting capillary 911 turns into a short microchannel 912 having a narrow orifice followed upon a wide chamber 913, a further short microchannel 914 and a comparatively wide connecting capillary 915 used as a waste exit channel. The capillary 915 can be connected via an inlet 916 to a waste chamber (not shown). The waste chamber inlet can contain notches 917. The waste chamber inlet can be an integral hollow space of the platform 721.

The elements 912, 913 and 914 can serve as flow restrictors or "flow gates" and capillary stop structures for gating of fluids. These elements also can act as diffusion barriers between the connecting capillary 911 and the connecting capillary 915 due to the reduced cross-sectional are of the microchannels 912 and 914 and the comparatively large volume of the wide chamber 913 in between.

On the other hand the elements 912, 913 and 914 can be positioned at the end of the filling section. In this case the connecting capillary 915 of FIG. 9 corresponds to the connecting capillary 717 of FIG. 8 and the capillary 911 of FIG. 9 is connected to one end of the filling channel 714 of FIG. 7A. Thus the analysis section is fluidally more isolated from the filling section and the "cross-talk" of the remaining fluids from the filling section with fluid being contained in the analysis section is reduced.

The wide chamber 913 can serve as an evaporation chamber for the fluid. This is of particular importance when e.g. standard hybridisation protocols are performed where large variations of temperature are applied. A preferred application is the use of thermocycling processes for the replication of nucleic acids such as employed in the polymerase chain reaction (PCR) where temperature variations from 25° C. to 90° C. are applied during the hybridisation procedure.

Exemplary dimensions of devices according to the invention shown in FIGS. 1 and 6 are: width about 25 millimeter, length about 75 millimeter and thickness about 2 millimeter. Exemplary dimensions of channel 811 in FIG. 6 are width about 3 millimeter and height about 50 micrometer.

The invention has been described in detail with reference to preferred embodiments thereof. However, it will be appreciated that those skilled in the art, upon consideration of this disclosure, may make modifications and improvements within the spirit and scope of the invention.

What is claimed is:

1. A microstructured device for transport of fluids by capillary force within a closed configuration comprising:

at least an inlet port which is fluidically connected to an entrance of at least a filling section at an exit of which at least an analysis chamber is located between a first plate and a second plate, the analysis chamber comprising side walls separating the first plate and the second plate; and at least a fluid flow channel within the filling section, wherein the analysis chamber is a straight hollow chamber having a length, a width, and a height, wherein the length is parallel to the flow direction of the fluid between the first plate and the second plate, and the width is greater than the height, both the width and the height being perpendicular to the length of the chamber, and the side walls of the analysis chamber comprise one or more pre-shooter stop structures which promote uniform capillary flow in the microstructured device of the closed configuration.

2. The device of claim 1, wherein the at least one fluid flow channel comprises one or more bifurcations from a source fluid flow channel into two channels of the bifurcation and each bifurcation comprises a bifurcation flow-through structure, comprising a V-shaped structure, wherein the top of the V extends into the source fluid flow channel and the cross-sectional area of the source fluid channel feeding fluid into the two channels downstream of the V-shaped structure is about the same as the cross-sectional area of the two channels together.

3. The device of claim 1 wherein the pre-shooter stop structures comprise irregularly shaped structures.

4. The device of claim 1 wherein the pre-shooter stop structures comprise triangular or sawtooth shaped structures.

5. The device of claim 4 wherein the pre-shooter stop structures have an angle of from about 1° to about 120°.

6. The device of claim 4 wherein the pre-shooter stop structures have a height of from about 1 μm to about 3 mm.

* * * * *